United States Patent [19]

Gambello

[11] Patent Number: 5,040,694

[45] Date of Patent: Aug. 20, 1991

[54] LOCKING REMOVABLE CAP AND METHOD OF ASSEMBLY AND INSTALLATION THEREOF

[76] Inventor: Vincent J. Gambello, 90 Prospect Ave., Apt. 3-D, Hackensack, N.J. 07601

[21] Appl. No.: 304,722

[22] Filed: Jan. 31, 1989

[51] Int. Cl.[5] ..... B65D 51/18

[52] U.S. Cl. ..... 220/255; 220/256; 220/85 P; 215/225; 222/182

[58] Field of Search ..... 215/206, 216, 225; 220/255, 256, 85 P; 222/153, 182

[56] References Cited

U.S. PATENT DOCUMENTS

| | | | |
|---|---|---|---|
| 3,037,672 | 6/1962 | Gach | 222/182 |
| 3,049,263 | 8/1962 | Edelstone et al. | 220/85 P X |
| 3,430,796 | 3/1969 | Berg | 215/206 |
| 3,450,290 | 6/1969 | Turner | 215/225 |
| 3,669,296 | 6/1972 | Drew et al. | 215/206 |
| 3,690,519 | 9/1972 | Wassilieff | 220/85 P X |
| 3,706,401 | 12/1972 | Gach | 222/153 |
| 3,799,392 | 3/1974 | Richards | 215/225 X |
| 3,820,683 | 6/1974 | Jasinski | 215/216 X |
| 3,854,622 | 12/1974 | McKirnan | 220/306 |
| 3,870,187 | 3/1975 | Bennett | 220/281 |
| 3,871,544 | 3/1975 | Peyser | 215/225 |
| 3,934,751 | 1/1976 | Green et al. | 220/85 P X |
| 3,995,765 | 12/1976 | Burke | 220/281 |
| 4,260,067 | 4/1981 | Andruchiw | 215/216 X |
| 4,303,175 | 12/1981 | Lux | 220/85 P X |
| 4,315,576 | 12/1982 | Murphy et al. | 220/282 |
| 4,779,747 | 10/1988 | Morel | 215/206 |

*Primary Examiner*—Stephen Marcus
*Assistant Examiner*—Nova Stucker

[57] ABSTRACT

A childproof, locking-type cap is disclosed. Briefly stated, an upper cap is mated to a lower cap so as to be axially pivotable thereabout. A plurality of wings are provided, each of which has an engaging rib which engages the rim on the top of a container such as an aerosol can or the like. Alignment of the upper and lower caps permit at least one wing to be moved out of the way when the cap assembly is removed from the container.

15 Claims, 4 Drawing Sheets

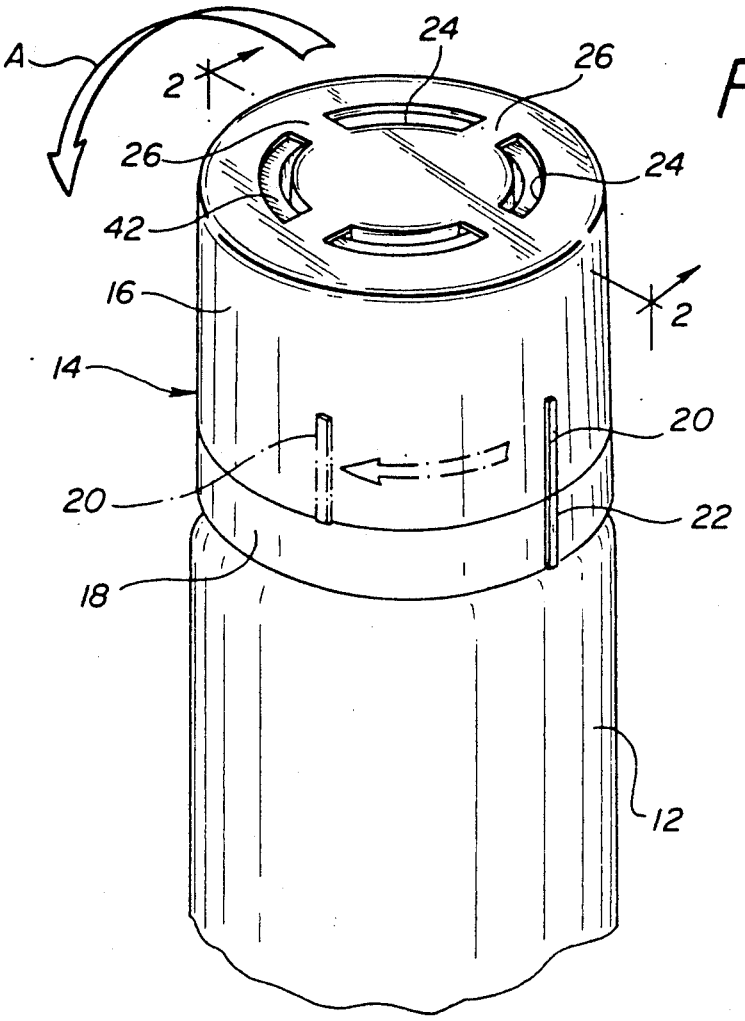
FIG-1
FIG-2A
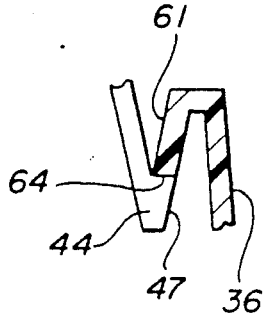
FIG-2
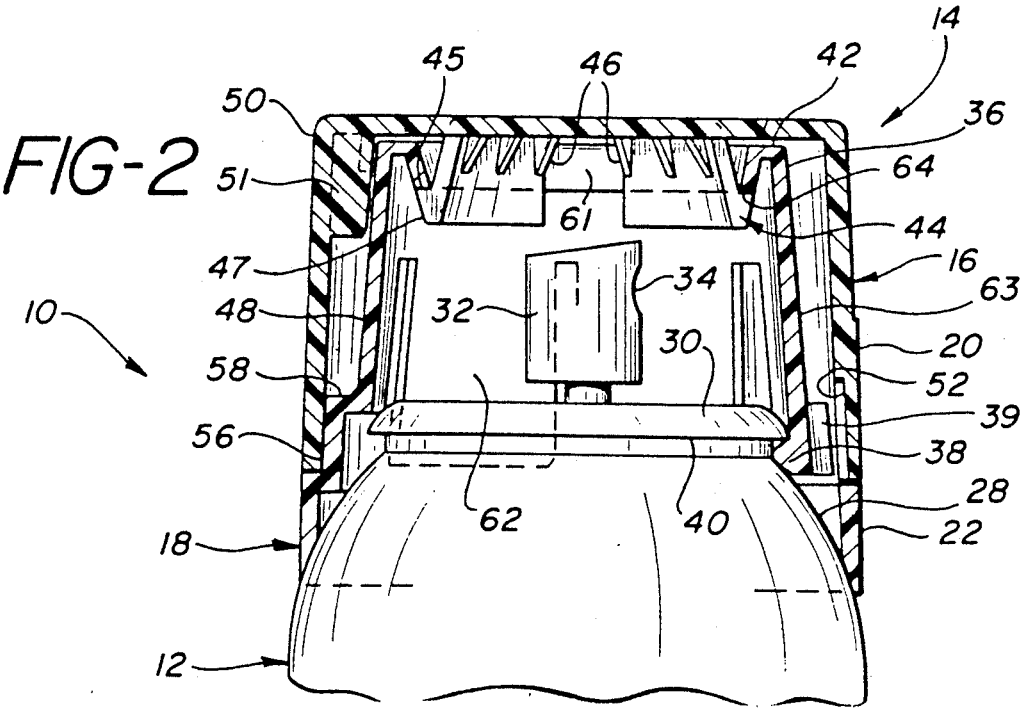

LOCKING REMOVABLE CAP AND METHOD OF ASSEMBLY AND INSTALLATION THEREOF

BACKGROUND OF THE INVENTION

1. Field of the Invention

This invention relates, generally, to a safety-type cap and, more particularly, to a safety cap which is readily removable from a can or other similar enclosure without the use of undue force.

2. Discussion of the Prior Art

Ever since product safety awareness has become an important factor in packaging, numerous attempts have been made to prevent the unintended opening of containers, such as spray cans, screw tops and the like. This perennial solution was made more acute with various legislation mandating "child-proof" caps on various containers. Marketing considerations also required companies to produce a product package according to the demands of the consumer.

Accordingly, a number of child-proof or tamper-proof caps have been produced in this vein. One such example may be found in U.S. Pat. No. 3,037,672 "Dispenser Container with Tamper-Proof Replaceable Cap", issued June 5, 1962 to Gach. Gach requires the breaking of an integral portion of the cap before initial use, the cap thereafter serving as a conventional cap. Therefore, while this type of cap is sufficient to initially protect or prevent child tampering, it fails to provide the same level of protection on a continuing basis.

U.S. Pat. No. 3,690,519 "Closures for Containers", issued Sept. 12, 1972 to Wassilieff, is similar to the Gach patent in that an intermediate element is utilized which must be broken away before removal of the cap is permitted and therefore suffers from the same defect as the Gach reference.

U.S. Pat. No. 3,706,401 "Child-Proof Overcap for an Aerosol Can", issued Dec. 19, 1972 to Gach is more in line with the continuing child-proof protection and requires removal of the cap by pressing down upon the top thereof and simultaneously rotating it. While this does provide continued protection, it suffers from the disadvantage that substantial force is required in conjunction with turning in order to remove the cap. Therefore it is most inconvenient and difficult to use.

U.S. Pat. No. 3,820,683 "Spray Can Safety Cap", issued June 28, 1974 to Jasinski, suffers from much the same defects as the '401 reference in that squeezing or force, coupled with pulling, is required in order to remove the cap. An alternate embodiment allows for pushing of a component of the cap coupled with removal of the cap. However, these alternate designs and the basic concept still suffer from the defect. That is, substantial force is necessary in order to remove the cap.

Another type of child-proof container or cap may be found in U.S. Pat. No. 3,870,187 "Child-Proof Aerosol Cap", issued Mar. 11, 1975 to Bennett. This device facilitates removal of the cap by prying, such as through the use of a tool or the like. Another device which is conceptually similar to the Bennett reference is U.S. Pat. No. 3,854,622 "Childproof Cover", issued Dec. 17, 1974 to McKirnan and is indeed issued to the same assignee as the Bennett reference. This disclosure is somewhat similar to the previous patents in that squeezing of the cap coupled with pulling is required in order to remove the cap.

Another operatively similar device is disclosed in U.S. Pat. No. 3,934,751 "Safety Overcap for Dispensing Containers", issued Jan. 27, 1976 to Green et al. Green requires squeezing in order to releasably remove a portion of the container from the edge or lip of the container which must then be coupled with pulling of the cap away from the container.

U.S. Pat. No. 3,995,765 "Safety Closure for Containers", issued Dec. 7, 1976 to Burke improves slightly upon the previously mentioned squeeze and pull type of operation by providing a pair of opposed, longitudinally extending slots. U.S. Pat. No. 4,303,175 "Overcap Assembly for Valved Containers", issued Dec. 1, 1981 to Lux, requires exertion of pressure coupled with rotation thereof to remove the cap. U.S. Pat. No. 4,315,576 "Child Resistant Closure Cap Apparatus Employing Fulcrum Action", issued Feb. 16, 1982 to Murphy et al. requires sheer force in order to cause the cap to pivot about a fulcrum and release the cap from the container.

However, while all of the above-mentioned patents offer safety advantages over simple screw-type or pop-off type lids, they all suffer distinct disadvantages. Some of these disadvantages, in addition to those previously mentioned, are complex mechanical arrangements, critical wall thicknesses and the like. Additionally, one of the prime disadvantages is the requirement that substantial force be utilized in one fashion or another to remove the cap. Such force may take the form of squeezing, pulling, pushing or the like.

Furthermore, a significant number of these require coaction or two movements in order to remove the cap. That is, they require force in two (usually perpendicular) directions in order to remove the cap. Therefore, many require the use of squeezing and rotation or squeezing and pulling in order to remove the container. Therefore, while they satisfy the function of providing childproof safety caps, they are most difficult to utilize by the aged, disabled or crippled individual.

This is a particularly acute problem since it is well known that aged individuals simply do not have sufficient muscular strength in order to remove caps of this type. Further, they are often saddled with arthritis or other similar types of infirmities making such movements or the exertion of such force painful. Additionally, disabled individuals may simply not have the coordination to perform two functions, such as squeezing and pulling or squeezing and rotating.

Therefore, what is an advantage for younger, more capable individuals having children, is a distinct disadvantage for older or disabled individuals. This proposes a difficult problem for manufacturers which must then either lose sales to other products having perhaps less safe childproof caps to those which are more easily operable by the consumer. The extent of the "migration" will depend upon the individual's infirmity. Alternately, the manufacturer is forced to distribute their product having two different types of cap. It is well known that production of two different types of cap raises a number of problems, among them is the increased costs in separate distribution, manufacture and the like. Another problem is the danger of non-childproof containers winding up in households having children.

Accordingly, it is an object of the present invention to produce a device which is inexpensive to manufacture. It is a further object of the present invention to produce a device which is easy to assemble. Still a further object of the present invention is to produce a device which is easy to utilize.

A still further object of the present invention is to produce a device which does not require dual or contemporaneous motion, such as squeezing and lifting or the like. Yet another object of the present invention is to produce a device which is readily usable by the handicapped. A further object of the present invention is to produce a device which does not require significant force. Yet another object of the present invention is to produce a device which is capable of being used by aged and/or arthritic hands.

Still another object of the present invention is to produce a device which is childproof. Yet another object of the present invention is to produce a device which does not require that to be used on specially adapted containers or specially designed containers.

A further object of the present invention is to produce a device which may be repeatedly used during the life of the container. Still a further object of the present invention is to produce a device which does not require breaking away of a portion of the top or the like in order to initially remove the top. Yet another object of the present invention is to produce a device which does not require use of any tool, special or otherwise, in order to remove the top.

Yet another object of the present invention is to produce a device which is injection moldable and which may utilize low cost plastics suitable for high volume production.

Additionally, it is another object of the present invention to produce a locking removable cap for a container which has a lip thereon, having a first cap comprised of an annular ring, at least one vertically upstanding wall extending from the annular ring, at least two urgeable tabs coaxially extending downward from the annular wall, at least one retaining ledge disposed on each coaxial tab, which engages the lip of the container and thereby secures the cap to the container; and an overcap which is pivotable around the longitudinal axis of the first cap and which is comprised of an annular shell having a recess of reduced wall thickness which is rotatable into and out of alignment with at least one of the tabs, thereby respectively permitting and prohibiting radial outward movement of the corresponding tab and the retaining ledge out of engagement with the lip of the container for respectively permitting and prohibiting the removal of the locking removable cap from the container.

ADDITIONAL OBJECTS OF THE INVENTION

Accordingly, a further object of the present invention is to provide a device which can be easily assembled in a manufacturing process in a variety of ways to facilitate installation on the can it will be applied to.

A further object of the invention is to provide a cap which utilizes the construction features of a standard aerosol can or container to enhance the effectiveness of the locking device. Another object of the present invention is to provide a locking cap which has coaction between the overlapping shaping of the upper and lower surfaces of the ferrule on a standard aerosol can with the can engaging surface of the cap to ease the installation of the cap on the can and to restrict removal of the cap from the can.

Still another object of the present invention is to provide a method of assembling a lockable cap which can be performed in a single simple operation, and which then fixedly secures the two elements in a rotatable coaction. Another object of the present invention is to provide a method for assembling a lockable cap which can utilize the ultimate application can as affixed during the assembling process.

Still a further object of the present invention is to provide a method of placing and securing a cap to an aerosol can which can be done simply without requiring alignment or a complex sequence of operations, and which removal can be accomplished simply and easily without undue strength or exertion of force, and which can be done by a simple manipulation of a rotatable portion of the cap to place the cap in an unlocked position.

BRIEF DESCRIPTION OF THE DRAWINGS

Reference may be now had to the accompanying drawings in which:

FIG. 1 is a perspective view of the removable cap of the present invention as utilized on a container;

FIG. 2 is a cross-sectional view taken through the cap shown in FIG. 1;

FIG. 2A is an enlarged segmented view of the coaction of different portions of the cap.

DETAILED DESCRIPTION OF THE PREFERRED EMBODIMENT

Figure 3:
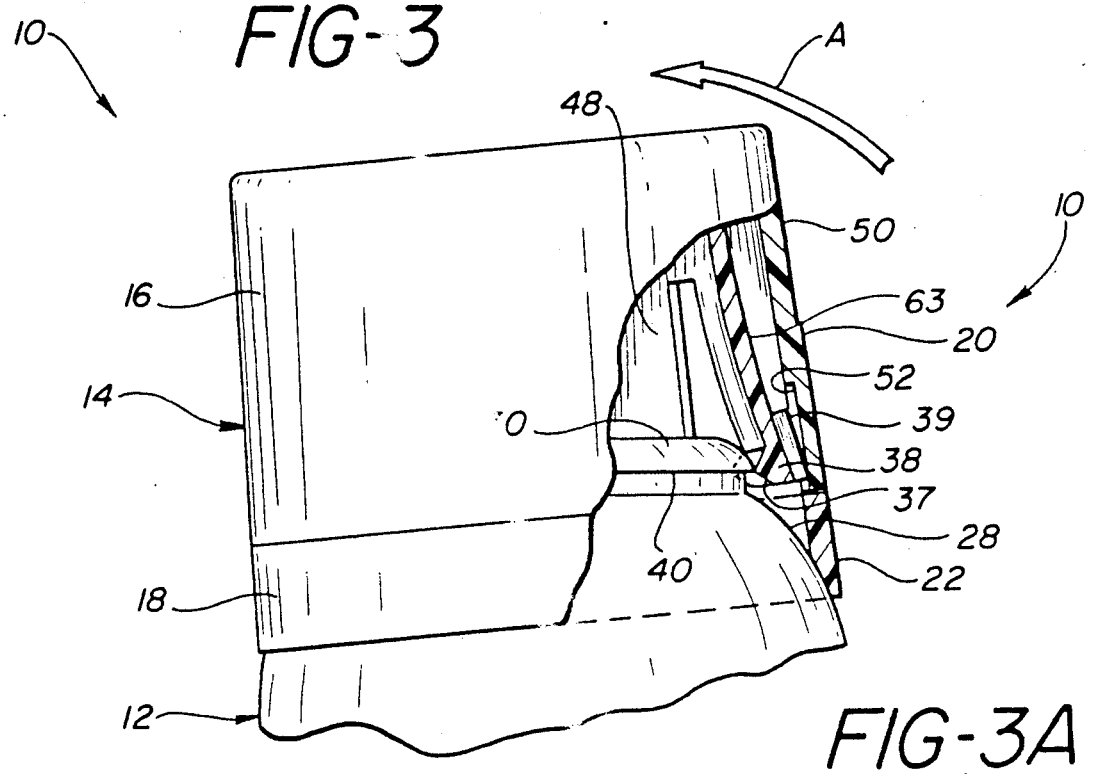
FIG. 3 is a side elevational view in partial cross-section showing removal of the cap from the container.

Referring now to FIG. 3, an elevational view having a portion cut away therefrom is shown. Illustrated is an aerosol can and top, shown generally at 10, which is comprised of an aerosol can 12 and the locking cap 14 of the present invention. It is to be understood that almost any type of can or container may be utilized in which the can has a rim (FIG. 2) or other suitable registration means. The locking cap 14 is preferably comprised of injection molded plastic although other methods of manufacture and materials may be utilized without departing from the spirit and scope of the present invention.

In the preferred embodiment of the present invention, aerosol can 12 has disposed at the upper end, an aerosol can ferrule 30 having a ferrule lower lip or ridge 40. The ferrule and lip 30, 40 are used to engage portions of the locking cap 14 as disclosed below. By lip is meant any form of retaining area and may be, for example, a series of interspaced indentations/ protrusions which may even be disposed along the outer casing of the can 12.

Figure 5:
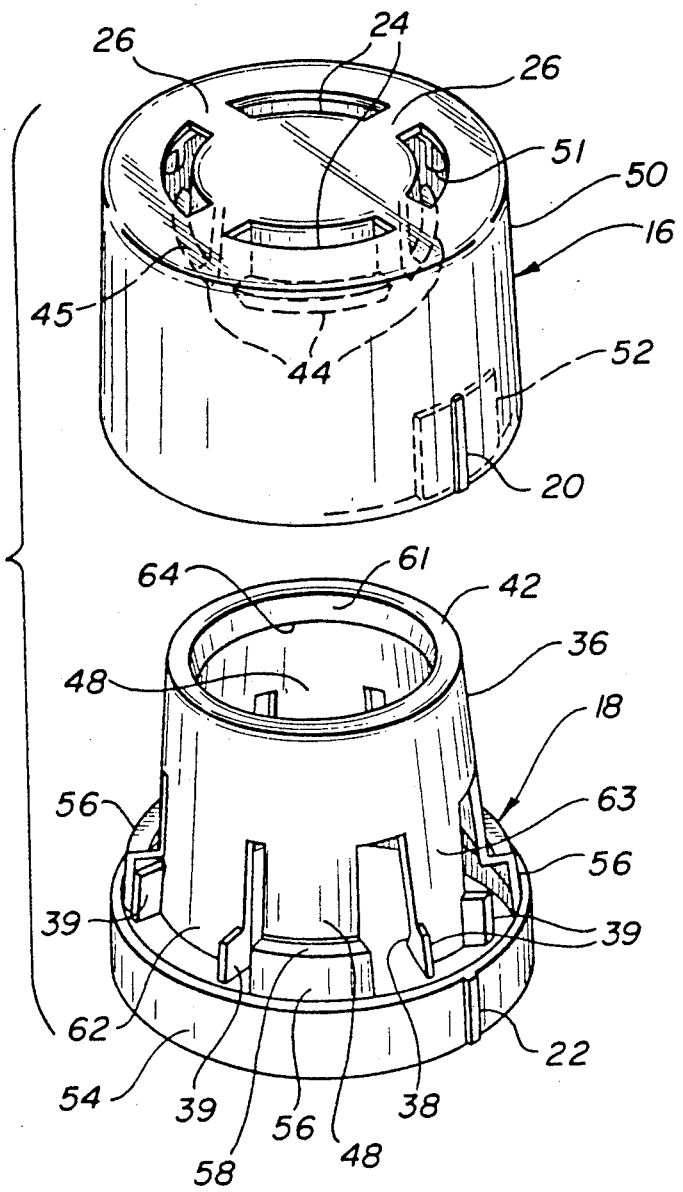
FIG. 5 is an exploded perspective view from above of the top and bottom portions of the protective cap of the present invention.

Locking cap 14 is comprised of two portions, an outer or upper overcap 16 and an inner or lower cap 18 (FIG. 5). It is to be understood that the upper and lower caps 16, 18 are manufactured separately and assembled prior to distribution to an end user with the result that the end user only has one assembly, locking cap 14 to place onto the container. Upper and lower caps 16, 18 are, with respect to each other, rotatable about their perpendicular axes.

Referring now to FIG. 1, the operation sequence for removal of locking cap 14 from aerosol can 12 may be more easily understood. Disposed on the outer circumference of upper and lower caps 16, 18 are upper and lower alignment ribs 20, 22 respectively. To accomplish removal of locking cap 14 from aerosol can 12, upper and lower alignment ribs 20, 22 are aligned and pivoting force along the direction of arrow A (FIGS. 1 and 3) is exerted. In the preferred embodiment of the present invention, removal of locking cap 14 can only be accomplished by alignment of upper and lower ribs 20, 22 and pivoting in the direction of arrow A. Pivoting or exertion of force in any direction other than arrow A will not facilitate removal of locking cap 14 from aerosol can 12.

Referring now to FIGS. 2, 2A, 3, 3A, 5 and 5A, an illustration of the internal configuration of the locking cap of the present invention is shown. As stated previously, locking cap 14 is comprised of upper and lower caps 16, 18 respectively. Lower cap 18 is in the form of a truncated cone and is a comprised of a lower wall/collar or ring 54, having extended therefrom and attached thereto three spaced uprights 56 which extend up to and form part of upper wall 36. Circumferential upper wall 36 is truncated so as to form an inner cap upper ledge 42. Disposed between each upright 56 and extending downward from the upper wall 36 in the direction of collar or ring 54 are two similarly sized wings 62 and an abbreviated wing 63. The abbreviated wing 63, in the preferred embodiment of the present invention, is adjacent lower alignment rib 22. Extending at an angle from each wing 62, 63 are tabs 39 which rest against the inner surface of upper cap 16 when upper and lower caps 16, 18 are mated, as shown more clearly in FIGS. 2 and 6. Disposed opposite tabs 39 on the inner surface of wings 62, 63 are inner cap engaging ribs 38 which engage the ferrule lower lip/ridge 40 of aerosol can ferrule 30. In this regard, wings 62, 63 are movable slightly radially inwardly and outwardly so as to allow engagement and disengagement respectively with ferrules 30, 40.

Upper cap 16 is generally circumferential in shape and configures so as to mate with lower cap 18. Disposed on the outer surface of upper cap 16 is upper alignment rib 20. Opposite the alignment rib 20 on the interior of outer wall or skirt 50 is recess 52. The width of recess 52 is slightly larger than the distance between tabs 39 of abbreviated wing 63 and less than the distance between tabs 39 of remaining wings 62. In this manner, when alignment ribs 20, 22 are aligned, recess 52 is adjacent abbreviated wing 63, as shown in FIGS. 2 and 3. Accordingly, pivotal movement of the locking cap 14 in direction of arrow A (FIGS. 1 and 3) allows inner cap engaging rib 38 to ride over ferrules 30, 40 in that tabs 39 are urged into recess 52 as a result of the bending movement of abbreviated wing 63. Therefore, once rib 38 is urged past or just beyond the outermost diameter of ferrules 30, 40, wings 62 are urged outwardly just enough to facilitate removal of cap 14 due to the flexibility of wings 62.

The assembly of the cap 14 is formed by virtue of upper cap 16 being resiliently and pivotally captured to lower cap 18 by means of locking ribs 44 which mate with and engage annular retaining ledge 64 disposed adjacent the inner cap upper ledge 42 of lower cap 18. The coaction of the various elements in assembly of the cap must be detailed to be appreciated. The top and bottom elements of the cap, once assembled, are permanently fastened to each other, yet with the ability for the top to rotate relative to the bottom.

The assembly has been designed to facilitate a production process in which a single actuating stroke will join the top and the bottom elements into a single unified structure. It is most clearly shown in FIG. 2A. The joining is accomplished by the tapered inner conical surface of the annular support ring 61 wedging or deforming the locking ribs 44 of the entire portion of the cap inward until the outermost surface 47 of the locking rib 44 which is tapered at the same angle as the conical taper of the support 61 passes below the bottom surface 64 of the support ring 61. At this point the displaced locking rib will resiliently return to its original shape, thereby seating the upward facing capturing edge 45 of locking rib 44 against the downward facing bottom surface 64 of the annular, conical, support ring 61.

The coaction of capturing edge 45 and bottom surface 64 provide a bearing surface for the relative rotation of the top and bottom portions of the cap.

Additionally, it should be pointed out, that the design of the coaction between the locking ribs 44 and the support ring 61 enable each piece to be fabricated without any undercutting, which enables the devices to be easily molded without expensive or unusual molding techniques, and requires no additional manufacturing or finishing steps after the molding process.

It should also be noted that the ease of assembly of the top and bottom of the cap enhance its mass producability by lowering the cost of molding and the cost of assembly and further reducing the cost of installation of the can that will be the ultimate application for the cap.

All that is necessary to assemble the cap is a simple downward push which locks the elements of the cap into a permanent assembly. Therefore, for example, it would be possible to assemble the caps and then install them on the cans or alternately to install the bottom part of the cap on the can and then easily join the top portion of the cap to the already installed bottom portion. In the latter case, the can then be used as a fixture in the assembly process.

Figure 6:
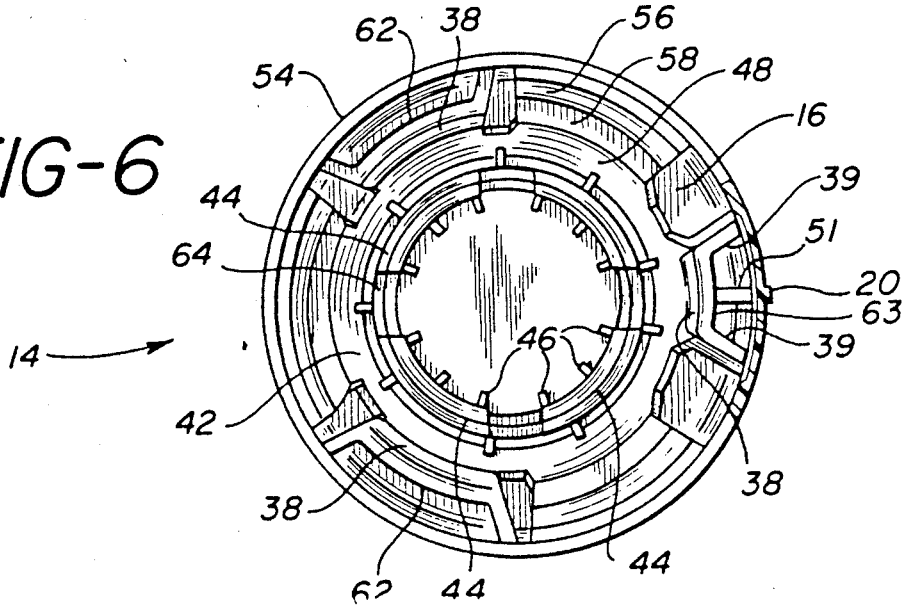
Figure 5A:
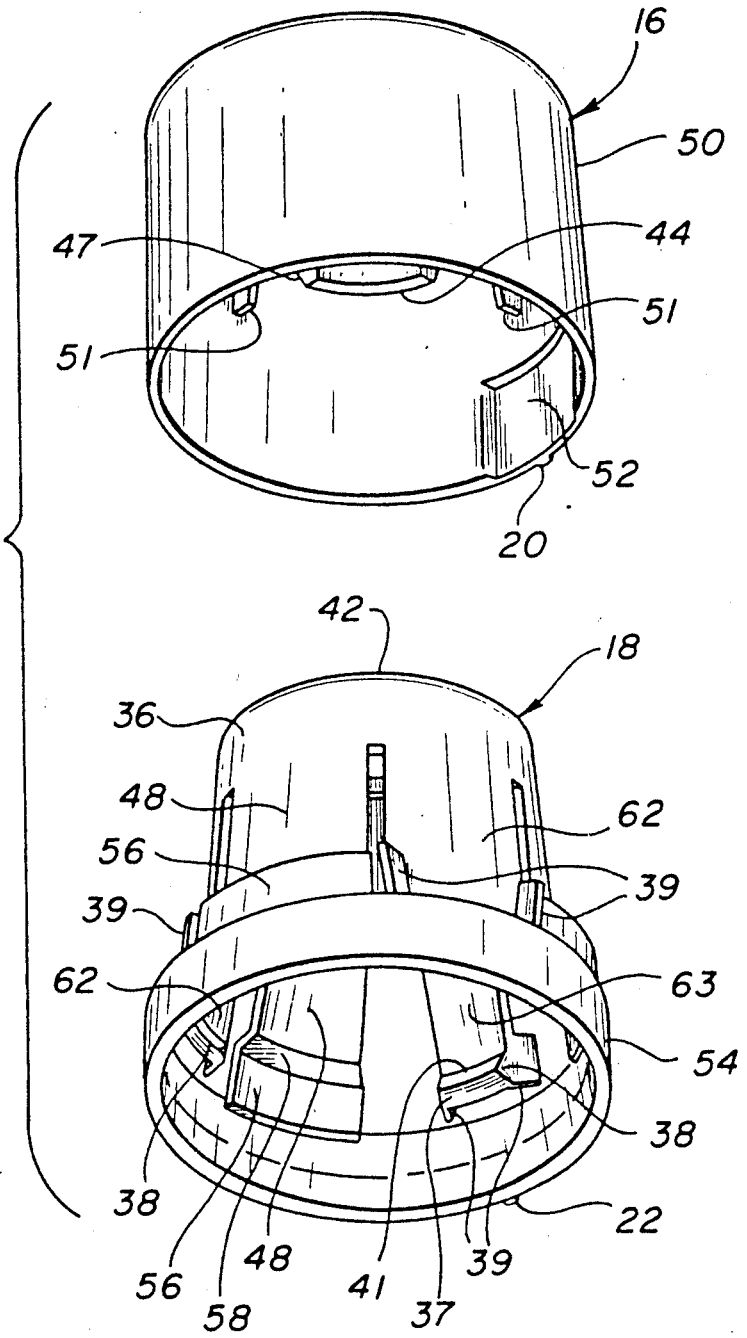
FIG. 5A is a exploded perspective view from below of the protective cap of the present invention; and, FIG. 6 is a view of the underside of the assembled protective cap of the present invention.

Referring now to FIGS. 2 and 6, a more detailed view of the construction and operation of the present device may be seen. Shown is can 12 having disposed thereon a spray button 32 having an aperture 34 for dispensing of the material in the can 12. It is to be understood however that any type of container may be utilized other than an aerosol container without departing from the spirit and scope of the present invention. For example, the can may be plastic, glass or other suitable material and does not have to be pressurized, but may in fact be a "pump" type of dispenser. Alternately, the container may have a screw-type top or any other suitable type top such as force fit or the like.

Disposed adjacent locking ribs 44 are upper cap support or reinforcing ribs 46 which minimize movement of locking ribs 44 and thereby prevent movement of locking ribs 44 and hence decoupling of upper cap 16 from lower cap 18. Disposed in the top of the upper cap 16 are arcuate slots 24 having connecting portions 26 disposed therebetween which are utilized to support and position the locking ribs 44 in the upper portion of upper cap 16. Support ribs 51 are disposed adjacent connecting portions 26 and cooperate with annular support ring 61 in providing structural integrity to the top portion of upper cap 16 and support to the conical surface of the inner cap to prevent cocking of the top portion of the cap with the bottom portion. This cocking would otherwise occur during attempts to remove the cap from the container whether in the locked or the unlocked position.

Ledges 58 are utilized so as to create a vertical wall/ inner skirt 48 with the result that wings 62, 63 and hence tabs 39 may be naturally radially disposed away from the inner wall of upper cap 16. It has been found that this design is optimum in that it allows for maximum compressibility of wings 62, 63 and naturally accommodates for variations in the diameter and configurations of different ferrules 30, 40.

Operation of the present device is extremely simple and foolproof. More particularly, in order to remove cap 14 from can 12, alignment ribs 20, 22 are positioned as shown in FIG. 1. This therefore aligns abbreviated wing 63 and hence tab 39 with recess 52. Therefore, upon upward urging of locking cap 14 along or coincident with the axis formed by alignment ribs 20, 22, engaging rib 38 is caused to be urged radially outward as it moves along ferrule 30, 40 due to the provision of space provided by recess 52. Therefore, when alignment ribs 20, 22 are aligned and movement is along any line other than that formed by arrow "A", removal of the cap is prevented since force will exerted on wings 62 which, due to their close proximity to the inner portion of outer skirt 50, are not outwardly urgeable.

Replacement of the cap is identical to any other forcefit type cap in that the cap 14 need only be pressed downward onto the top of can 12 with the result that wings 62, 63 are urged outward over ferrules 30, 40 and once past ferrules 30, 40 resiliently compress so as to have engaging rib 38 contact ferrule lower lip/ ridge 40, such as shown in FIG. 2. Further, due to the "urgeability" or bending of wings 62, 63, it is not necessary that alignment ribs 20, 22 be aligned in order to place cap 14 onto can 12.

In replacement of the cap, the outward movement of wings 62, 63 is initiated by the caming action of the ferrule of the can against the bottom surface of the engaging rib 38 on the wing 62, 63. The lower surface 37 of engaging rib 38 is angled opposite the upper surface 41 of engaging rib 38. This allows for the caming action of the upper surface of the can ferrule 30, with the lower surface 37 of the engaging rib, to spread the rib and allow the cap to fit over the ferrule.

Once past the widest part of the ferrule, the upper surface 41 of engaging rib 38, as well as the entire wing 63 will now resiliently move radially inward towards its original shape. At this point, the upper surface 41 of the engaging rib 38 will seat against lower surface 40 of the can ferrule to hold the cap on the can.

Figure 3A:
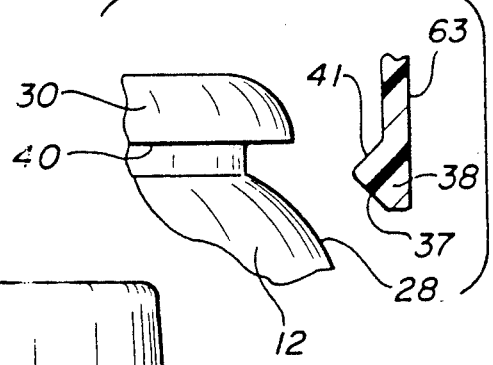
FIG. 3A is an enlarged segmented, exploded view of a portion of the cap and the can with which it coacts.
Figure 4:
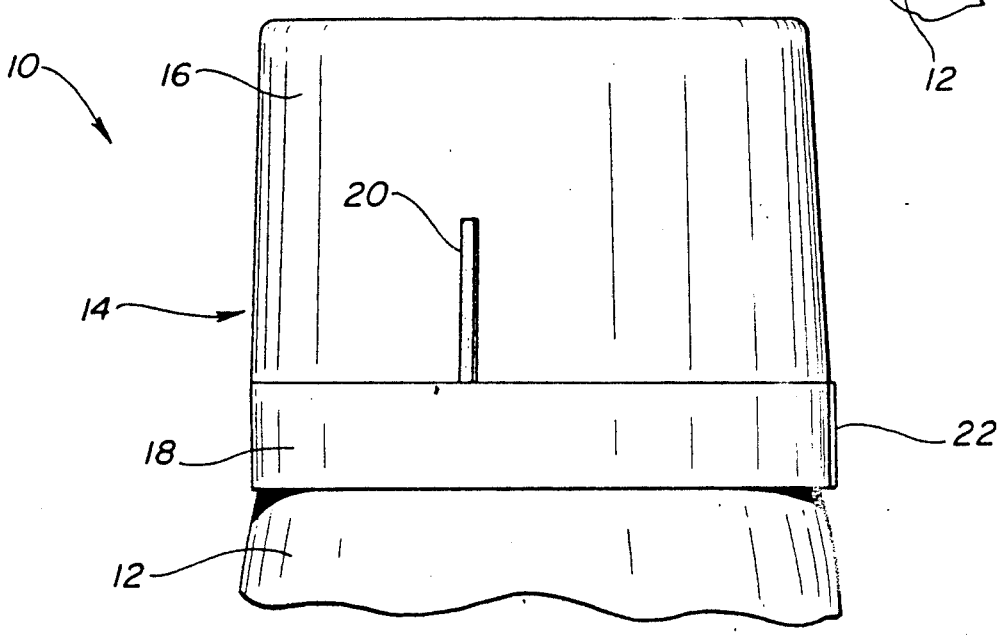
FIG. 4 is a side elevational view of the cap of the present invention.

As seen in FIG. 3A, the difference in the top 30 and bottom 40 shape of the ferrule on the can combined with the difference in the angle of the upper 41 and lower 37 surface of the engaging rib 38 allow for a greater caming action in seating the cap than in removing the cap. Therefore, significantly less force is necessary to replace the cap on the can or container than is necessary to remove the cap from the can or container. The cap can even be replaced on the can when it is in the locked position whereas it cannot be removed from the can (without a great deal of difficulty) unless in the unlocked position.

Note that the standard ferrule for a spray can or container has a smoothly descending surface formed by crimping the upper element over the bottom element at the neck of the can. The crimp or overlap produces an undercut created by the thickness of the top element where it terminates at its edge.

Accordingly, the present invention produces a device which is relatively easy to manufacture and assemble and which incurs low cost. Further, manufacturing tooling costs are minimized due to the relatively large tolerances which are permissible by virtue of the design of the cap.

It is to be understood that many variations of the present invention may be practiced without departing from the spirit and scope of the present invention. For example, different types or mechanisms upon which to attach the upper and lower cap to each other may be utilized. Further, different types or configurations of engaging ribs may be utilized while different numbers of wings and/or abbreviated wings may be used. Further, different materials such as metal may be utilized for the cap without departing from the spirit and scope of the present invention.

Additionally, the upper cap may be merely a rotating ring having the appropriate recess without departing from the spirit and scope of the present invention. Further, a weakened area may be substituted for the recess in the upper cap. Another alternate embodiment without departing from the spirit and scope of the present invention may be produced by allowing the upper cap to pop up after proper alignment with the lower cap, thereby allowing the wings to move. Further, a number of recesses which may or may not be evenly spaced could be utilized so that removal of the cap necessitates their alignment with similarly spaced wings before removal of the cap may be facilitated. Further, slots apertures or spaces between ribs in the upper cap may be utilized in place of the recess, thereby allowing the wings to partially protrude therethrough in order to facilitate removal of the cap.

Having thus described the present invention in detail, it is to be understood that the foregoing description is not intended to limit the spirit and scope thereof. What is desired to be protected by Letters Patent is set forth in the appended claims.

I claim:

1. A locking removable cap for a container having a lip thereon, comprising:

a first cap having at least one movable engaging rib for engaging a lip on a container and thereby retaining said first cap on a container; and an overcap, said overcap being an inverted cup-shaped cover, said overcap disposed about and mateable with said first cap, said overcap having an area alignable with said movable engaging rib for permitting movement of said engaging rib within said overcap out of engagement with a lip on a container.

2. A device according to claim 1, wherein said first cap has a retaining ledge and said overcap has a locking rib, said locking rib being mateable with said retaining ledge for pivotably securing said overcap to said first cap.

3. A device according to claim 1, wherein said overcap has a recess of reduced wall thickness, said recess being movable into and out of alignment with said engaging rib for respectively permitting and prohibiting the removal of said locking removable cap from a container.

4. A device according to claim 3, wherein said overcap means is rotationally movable into and out of alignment with said engaging rib.

5. A device according to claim 3, wherein said first cap has at least one resiliently biasable wing, said resiliently biasable wing having tabs extending outwardly therefrom, said tabs being alignable with said recess in said overcap.

6. A locking removable cap for a container having a lip thereon, comprising:

first cap means comprised of an annular ring, at least one annular vertically upstanding wall extending from said annular ring, at least two wings coaxially extending downward from said annular vertically upstanding wall, at least one of which is resiliently biased, at least one engaging rib disposed on each of said wings, said engaging rib engagable with a lip on a container for securing said cap to a container, and a plurality of tabs extending outward from said wings in a direction opposed to that of said engaging rib; and overcap means disposed around said first cap means, said overcap means comprised of an annular shell having a recess of reduced wall thickness, said recess being movable into and out of alignment with at least one of said tabs respectively permitting and prohibiting movement of said resiliently biasable tab, and thereby said corresponding engaging rib, out of engagement with said lip on a container for respectively permitting and prohibiting the removal of said locking removable cap from said container.

7. A device according to claim 6, wherein said overcap is an inverted cup-shaped cover.

8. A device according to claim 6, wherein said first cap has a retaining ledge and said overcap has a locking rib, said locking rib being mateable with said retaining ledge for pivotably securing said overcap to said first cap.

9. A device according to claim 6, wherein said overcap means is rotationally movable into and out of alignment with said tabs.

10. A device according to claim 6, wherein said tabs have outwardly extending wings disposed adjacent said overcap.

11. A locking removable cap for a container having a lip thereon comprising:

a first cap;

an overcap disposed about and mated to and rotationally movable about said first cap, said overcap being an inverted cup-shaped cover;

said first cap having at least one resiliently biasable wing having an engaging rib, said engaging rib engaging the lip on a container, wherein a portion of said overcap is movable into and out of alignment with said resiliently biasable wing for respectively permitting and prohibiting the removal of said locking removable cap from a container.

12. A device according to claim 11, wherein said first cap has a retaining ledge and said overcap has a locking rib, said locking rib being mateable with said retaining ledge for pivotably securing said overcap to said first cap.

13. A device according to claim 11, wherein said overcap has a recess of reduced wall thickness, said recess being movable into and out of alignment with said engaging rib for respectively permitting and prohibiting the removal of said locking removable cap from a container.

14. A device according to claim 11, wherein said overcap means is rotationally movable into and out of alignment with said engaging rib.

15. A device according to claim 13, wherein said resiliently biasable wing has tabs extending outwardly therefrom and in the opposite direction of said engaging rib, said tabs being alignable with said recess.

* * * * *